US005879818A

United States Patent [19]

Kinomura et al.

[11] Patent Number: 5,879,818

[45] Date of Patent: Mar. 9, 1999

[54] NICKEL-BASED ALLOY EXCELLENT IN CORROSION RESISTANCE AND WORKABILITY

[75] Inventors: Syoji Kinomura; Takao Kan; Yoshimi Yamadera, all of Amagasaki, Japan

[73] Assignee: Sumitomo Metal Industries, Ltd., Osaka, Japan

[21] Appl. No.: 893,553

[22] Filed: Jul. 11, 1997

[30] Foreign Application Priority Data

Jul. 15, 1996 [JP] Japan ..... 8-184954

[51] Int. Cl.[6] ..... B32B 15/02; F22B 37/04

[52] U.S. Cl. ..... 428/636; 428/679; 428/680; 420/586.1; 122/DIG. 13

[58] Field of Search ..... 428/679, 636, 428/680, 34.1; 122/DIG. 13; 420/586.1; 148/419, 442

[56] References Cited

U.S. PATENT DOCUMENTS 5,324,595 6/1994 Rosén .
5,378,427 1/1995 Otsuka et al. .

FOREIGN PATENT DOCUMENTS 0 120 704 A2 10/1984 European Pat. Off. .
0 262 673 A1 4/1988 European Pat. Off. .
29 29 811 A1 2/1980 Germany .
5-70891 3/1993 Japan .
WO 95/31579 11/1995 WIPO .
WO 95/31579 A 11/1995 WIPO .

OTHER PUBLICATIONS

Japanese Standards Association 1993 Handbook (JIS G 4903 & 4904); pp. 1727–1750.
Patent Abstracts of Japan, vol. 015, No. 069 (M–1083), 19 Feb. 1991 & JP 02 296 088 A (Kubota Ltd.), 6 Dec. 1990.
Patent Abstracts of Japan, vol. 13, No. 336 (C–23), 27 Jul. 1989 & JP 01 111838 A (Nippon Steel Corporation), 28 Apr. 1989.

*Primary Examiner*—Margery Phipps
*Attorney, Agent, or Firm*—Armstrong, Westerman, Hattori, McLeland & Naughton

[57] ABSTRACT

An alloy having an excellent corrosion resistance and workability and being suitable particularly for seamless tubes of the industrial waste incineration boiler. The alloy consists essentially of, in weight %,:

| | | |
|---|---|---|
| up to 0.05% C, | up to 0.5% Si, | up to 0.5% Mn, |
| up to 0.01% P | 20–25% Cr, | 8–12% Mo, |
| more than 0.5% and up to 1.0% Nb, | | more than 15% and up to 20% Fe, |
| up to 0.4% Al, | up to 0.1% in total of rare earth metals, | |
| up to 0.01% Ca, | up to 0.01% Mg, | up to 0.01% B, |

and the balance Ni and incidental impurities, wherein the Fe content and the Nb content are defined so as to satisfy the following formula (a):

$$Fe(\%) \geqq 4 \times Nb(\%) + 12.5 \quad (a)$$

6 Claims, 4 Drawing Sheets

NICKEL-BASED ALLOY EXCELLENT IN CORROSION RESISTANCE AND WORKABILITY

FIELD OF THE INVENTION

This invention relates to a comparatively cheap nickel-based alloy which has an excellent corrosion resistance in severe corrosive environments, good workability at room temperature and elevated temperatures. This invention also relates to a seamless tube and a composite seamless tube which are made of the above-mentioned nickel-based alloy.

BACKGROUND OF THE INVENTION

Metallic materials such as pipes, tubes and other structural members of apparatus for chemical plants and petroleum plants arc often used in environments wherein the materials are exposed to alkaline or acidic solution at high temperatures. Superheater tubes, evaporator tubes and structural members of boilers; heat exchanger tubes and condenser tubes of heat exchanging apparatus; and catalyst tubes are used in high temperature, high pressure and corrosive environments.

Boiler tubes, particularly for waste incinerating heat recovery boilers and black liquor recovery boilers (these boilers are referred to collectively as "industrial waste incinerating boilers" hereinafter) are subjected to severe attack of strong corrosive gas such as chlorine gas and hydrogen chloride gas, hydrochloric acid and sulfuric acid at elevated temperatures.

Corrosion resistant alloys are used for the materials of tubes which are exposed to such corrosive environments as mentioned above. For example, Ni-Cr-Fe alloys standardized in JIS G 4903 or 4904 are used for super sometimes. In six alloys standardized in said JIS, alloys named NCF 625 TP or NCF 625 TB which contain 8–10% Mo ("%" in chemical composition means "weight percent" herein) are often used particularly in severe corrosive environments.

NCF 625 TP alloy and NCF 625 TB alloy (referred to as "alloy 625" hereinafter) are Ni-based alloys containing 20–23% Cr, 8–10% Mo, up to 5% Fe and 3.15–4.15% "Nb+Ta" as the major alloying elements, and Al and Ti as the additional elements. The Ni content is restricted to be not less than 58%. The alloy 625 has an excellent corrosion resistance in the extremely severe corrosive environments due to beneficial effects of Cr, Ni and Mo.

Seamless tubes of the alloy 625 for a heat exchanger tube etc. are manufactured usually in a process comprising a step for making a tube blank by a hot extruding process such as Ugine-Séjournet process, and a step of cold rolling or cold drawing of the tube blank. Hot workability of the alloy 625 is so poor that the tube blank made by hot extruding has many surface defects generally. The surface defects should be removed before cold working. Since cold workability of the alloy 625 is not good, cold rolling or cold drawing ought to be performed by repeated passes at a rather small working ratio of each pass.

The productivity of the alloy 625 is low because of the above-mentioned complicated working process, and the low productivity together with high price of raw materials (Ni, Mo, Cr, etc.) makes the alloy 625 very expensive.

Since the alloy 625 originally has precipitation hardening property at about 650° C., toughness of the alloy is considerably reduced during long period use at temperatures over 500° C. Products of the alloy 625 for high temperature use may be broken by thermal-fatigue when they are subjected to heating and cooling cycles. Accordingly the reliability of the alloy 625 products at elevated temperatures is not large, and usage of the alloy is rather limited.

A high Mo nickel-based alloy having a workability better than that of the alloy 625 is disclosed in WO 095/31579 (PCT International Publication). In the alloy, Nb (which has a negative effect on the workability) is restricted to up to 0.5%. In spite of the small amounts of Nb, corrosion resistance of the alloy is said to be as good as the alloy 625. However, the "good corrosion resistance" has been found in a test wherein probes were placed at a specific location in a waste incinerator. Corrosion conditions vary broadly dependent on locations and combustion conditions in the incinerator. The "good corrosion resistance" described in WO 095/31579 is a property which has been recognized under a very specific corrosive condition.

The alloy disclosed in said WO 095/31579 contains Ti as a substantially indispensable component. Extruded tubular products of this alloy have surface defects, because Ti in the alloy combines with N in the air and forms massive TiN on the surface of the product during the tube making process.

Some superheater tubes and heat exchanger tubes are used at elevated temperature after forming, e.g., bending at room temperature. When tubes are installed in a water-wall panel of a boiler as steam generating tubes, they should be welded. The corrosion resistant alloy such as the alloy 625 becomes sensitive to corrosion when it is used at elevated temperatures without any heat treatment after cold forming. The welded portion (more specifically heat affected zone, HAZ) also becomes corrosion sensitive. Therefore, a reliable alloy for practical use ought to have good corrosion resistance after cold working or welding.

SUMMARY OF THE INVENTION

An object of this invention is to provide a nickel-based alloy which has the following properties all together.

(1) Corrosion resistance equal to or better than that of the alloy 625, particularly corrosion resistance enough to the practical use even if the alloy is cold worked and used under the condition wherein it becomes corrosion sensitive, or when the alloy is used after welding.

(2) Hot and cold workability superior to that of the alloy 625.

(3) Small toughness reduction due to aging after long period use at elevated temperatures, i.e., good structure stability.

(4) Being cheaper than the alloy 625.

Another object of this invention is to provide a seamless tube or a seamless composite tube made of the alloy having the above-mentioned properties, and being suitable particularly for the industrial waste incinerating boilers.

The present invention provides an alloy having the chemical composition described below, and a seamless tube made of the alloy or a seamless composite tube in which the outer layer, the inner layer or both of them are made of the alloy:

| | | |
|---|---|---|
| up to 0.05% C, | up to 0.5% Si, | up to 0.5% Mn, |
| up to 0.01% P | 20–25% Cr, | 8–12% Mo, |
| more than 0.5% and up to 1.0% Nb, | | more than 15% and up to 20% Fe, |
| up to 0.4% Al, | up to 0.1% in total of rare earth metals, | |
| up to 0.01% Ca, | up to 0.01% Mg, | up to 0.01% B, |

and the balance Ni and incidental impurities, wherein the Fe content and the Nb content are defined so as to satisfy the following formula (a):

$$Fe(\%) \geqq 4 \times Nb(\%) + 12.5 \quad (a)$$

Nb contains Ta which cannot be wholly separated from Nb because of technical difficulty of refining. JIS G 4903 and 4904 are defined such that the amount of "Nb+Ta" is 3.15–4.15%. This is based on the same reason as mentioned above. Therefore, Nb means "Nb+Ta" in this specification.

DETAILED DESCRIPTION OF THE INVENTION

Figure 1:
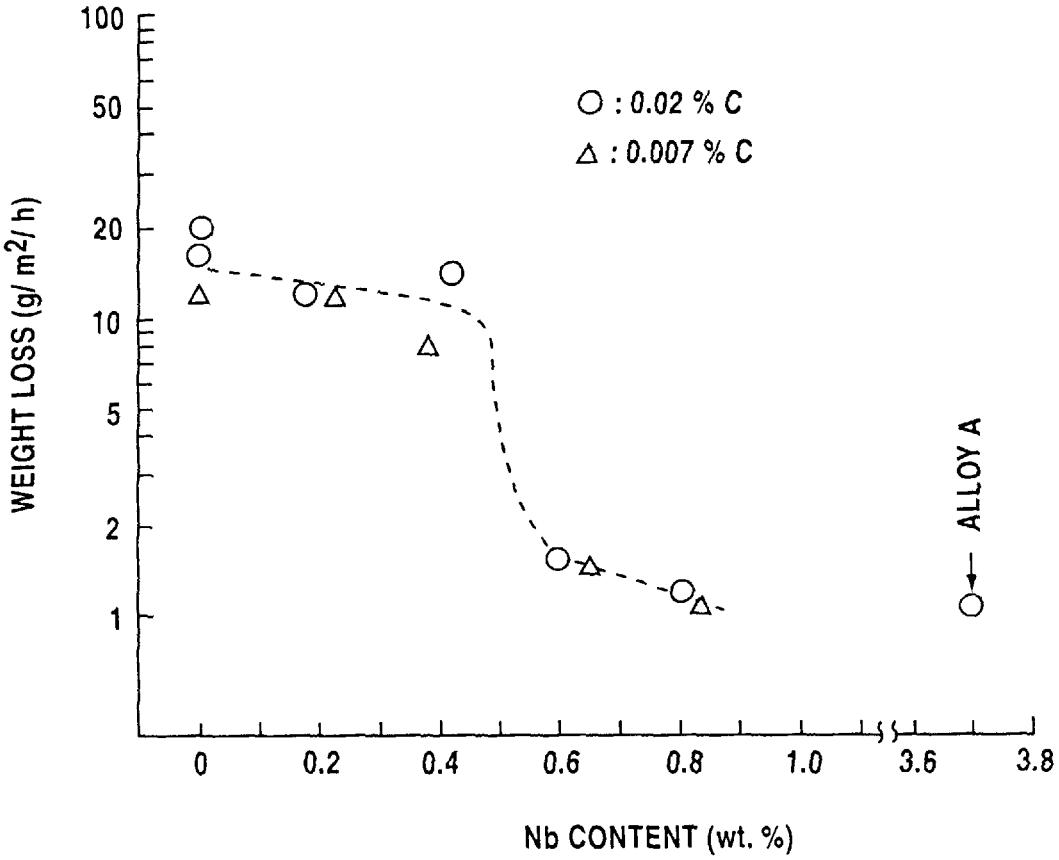
FIG. 1 shows Huey test results as a function of Nb content of the 20% cold worked alloys tested in Example.

The poor hot and cold workability and the structure instability of the alloy 625 at elevated temperatures come from the large amounts, i.e., 3.15–4.15% of Nb content.

Nb of such large amounts is added in order to obtain superior corrosion resistance and prevent the alloy from reduction of high temperature strength due to aging. Since, for instance, gas turbine blades should have very high strength at elevated temperatures, the alloy for such use must contain large amounts of Nb. However, the products such as structural members and tubular products e.g., seamless tubes for boilers or heat exchangers, for which the alloy of this invention is intended to be used, need not have such high strength. It is more important that the alloy has a good workability enough to be formed into seamless tubes and high temperature structure stability enough not to lose toughness at elevated temperatures as well as the good corrosion resistance approximately equal to the alloy 625.

It is supposed that the workability and high temperature structure stability can be improved by reducing Nb content. The alloy disclosed in said WO 95/31579 is assumed to have been invented on this understanding. However, too much reduction of Nb content worsens the corrosion resistance of the alloy. Nb forms carbide to fix carbon in the alloy and prevent forming of chromium carbide which makes the alloy sensitive to corrosion. Solubility of carbide in Ni-based alloy is so small that it is difficult to prevent carbide precipitation even if the carbon content is extremely low. Therefore, considerable amounts of Nb are necessary for the superior corrosion resistance, especially of a cold worked or a welded portion of products which become corrosion sensitive easily.

The present invention is based on the confirmation of Nb content which makes it possible to improve workability and still maintain good corrosion resistance, and the finding about suitable contents of other alloying elements. The structure stability of the alloy according to this invention after use at elevated temperatures for a long period is also improved by the suitable amounts of Nb. Therefore, the alloy does not become brittle after being used for a long period of time at elevated temperatures higher than 500° C.

Effects of alloying elements and reasons for defining the content of each element of the alloy according to this invention are as follows:

C (carbon)

When C content is too much, it combines with Cr to form chromium carbide, and thereby chromium shortage layers appear around grain boundaries. The alloy is easily subjected to intergranular corrosion, i.e., becomes corrosion sensitive. Therefore, C is restricted to up to 0.05%. Although it is preferable to minimize the C content, the lowest C content may be an amount which is attainable in the industrial refining process economically.

Si (silicon)

Si is effective as a deoxidizer. However, more than 0.5% Si makes the alloy sensitive to the high temperature embrittlement, because the Si promotes the brittle sigma (σ) phase precipitation in the alloy heated at about 650° C. Therefore, the smaller the Si content is the better in the range of up to 0.5%. If the alloy is sufficiently deoxidized by aluminum, addition of Si is not necessary.

Mn (manganese)

Mn is an austenite forming element, and is effective as a deoxidizer. However, more than 0.5% Mn reduces the hot workability of the alloy. Therefore, Mn content is restricted to up to 0.5%. If the alloy is deoxidized by Si or Al, addition of Mn is not necessary.

Cr (chromium)

Cr is one of the essential elements to improve corrosion and oxidation resistance of the alloy in various corrosive environments. When Cr content is not less than 20%, the effect becomes remarkable. However, if Cr content is more than 25% in the alloy containing relatively large amounts of Mo, a brittle α-Cr phase precipitates at elevated temperatures about 700° C., and toughness of the alloy decreases. Therefore, the proper range of Cr content is 20 to 25%.

Mo (molybdenum)

Mo improves resistance to pitting and crevice corrosion in chlorine ion containing environments, and resistance to the general corrosion in various acid solution and molten salt containing chlorides. The effects of Mo become remarkable when its content is not less than 8%, and saturates at more than 12%. Accordingly, the proper range of Mo content is 8 to 12%.

Al (aluminum)

Al is the essential element as a deoxidizing agent of the steel. Although Al does not necessarily remain in the alloy, it is preferable that more than 0.1% Al is contained in the alloy for the sufficient deoxidizing effect. If the Al content is more than 0.4%, brittle intermetallic compounds precipitate during hot working or a long period use at elevated temperatures, and thereby the creep strength and the toughness are reduced. Al content is therefore restricted to up to 0.4%.

Nb (niobium)

Nb has an effect to fix C due to forming carbide to prevent precipitation of chromium carbide, and thereby improve the resistance to intergranular corrosion of the alloy. On the other hand, Nb decreases the workability and structure stability.

FIG. 1 shows Huey test results as a function of Nb content. The test was carried out on 20% cold worked and sensitized test pieces of Nos.1 to 10 alloys in Table 1 described hereinafter. The conditions of Huey test will be described in section II-iv-① in Example hereinafter. It is apparent from FIG. 1 that the alloys containing more than 0.5% Nb, even if being subjected to the most sensitizing heat treatment, have markedly improved corrosion resistance of almost equal to that of the alloy 625.

Figure 2:
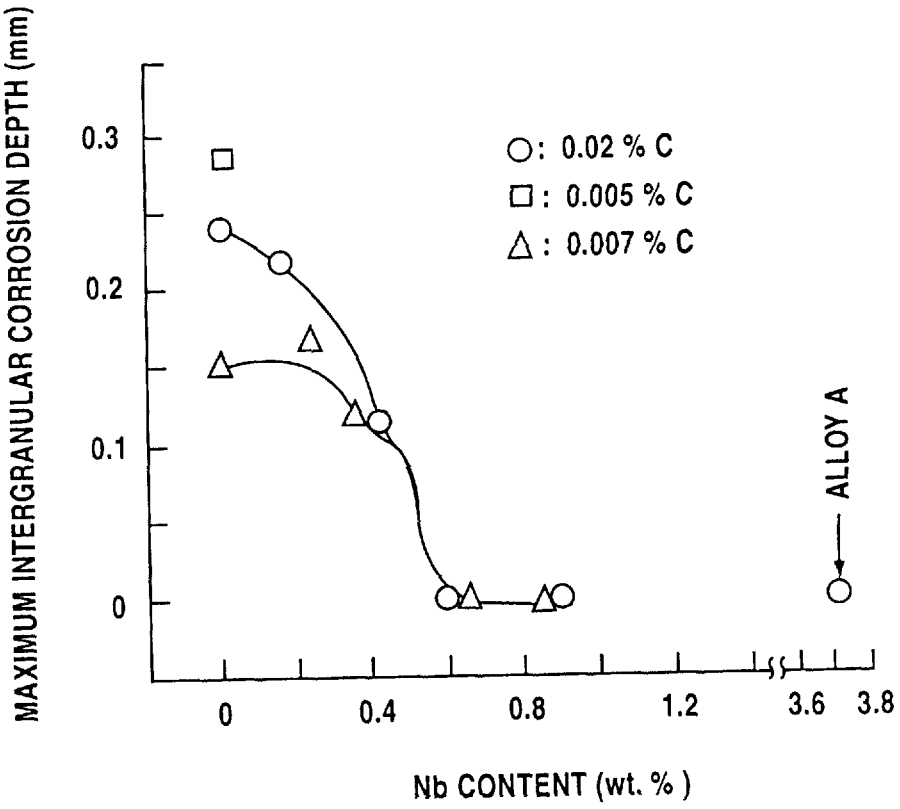
FIG. 2 shows results of a high temperature corrosion test (400° C.×20 hours) on heat affected zone (HAZ) of the alloys tested in Example as a function of Nb content.

FIG. 2 shows results of a high temperature corrosion test (400° C.×20 hours) on the heat affected zone (HAZ) of the alloys in Table 1 as a function of Nb content. The test conditions will be described in section II-vi in Example. It is apparent that the resistance to high temperature corrosion is remarkably improved when Nb content is more than 0.5%, independently of C content.

On the basis of the above mentioned test results it has been determined that more than 0.5% Nb is essential in the alloy of this invention.

On the other hand, excess amounts of Nb deteriorate the hot and cold workability and make the alloy sensitive to the high temperature embrittlement. Such detrimental effect of Nb can be moderated by Fe as is mentioned below. However, if Nb content is more than 1.0%, too much Fe is needed to moderate the detrimental effect of Nb, and unfavorable effect of Fe appears in turn. Accordingly, the Nb content should be not more than 1.0%.

Fe (iron)

Fe improves the hot workability of the alloy of the present invention. Furthermore, Fe prevents the Ni-based alloy containing Nb from the high temperature embrittlement caused by aging at elevated temperatures for a long period of time. As mentioned above, the alloy of this invention contains up to 1.0% Nb to improve corrosion resistance. Reduction of the hot workability and resistance to the high temperature embrittlement due to said high Nb content can be recovered by the addition of Fe.

Figure 3:
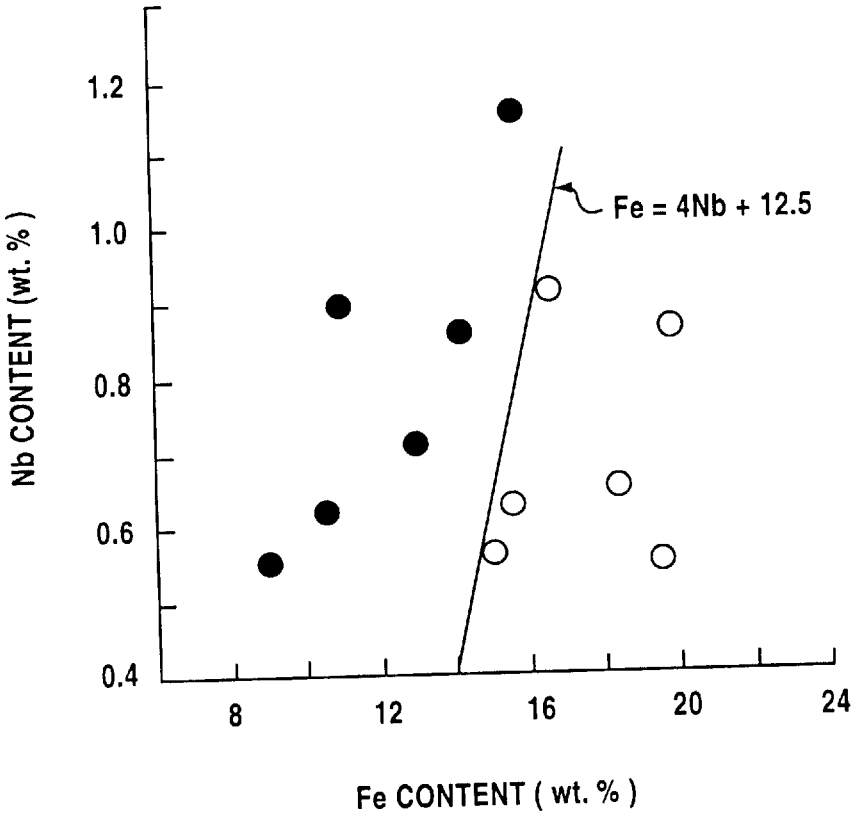
FIG. 3 is a graph showing results of Gleeble hot workability test as a function of Nb and Fe content of the alloys tested in Example.

FIG. 3 is a graph showing Gleeble hot workability test results of alloys Nos.11 to 25 (except Nos.21 to 23) as a function of Nb and Fe content. Details of the test conditions will be described in section II-i in Example. In FIG. 3, the superior hot workability (symbol ○) means not less than 60% reduction of area which is used as an index to estimate tube productivity in the hot extrusion process, and the inferior hot workability (symbol ●) means less than 10% reduction of area.

The straight line in FIG. 3 shows "Fe(%)=4×Nb(%)+12.5". The right side, i.e., the area of "Fe(%)≧4×Nb(%)+12.5" is the area of the superior hot workability. It is apparent that the alloy having the superior hot workability can be obtained by addition of more than 15% Fe in whole range of Nb content of the alloy according to this invention.

Figure 4:
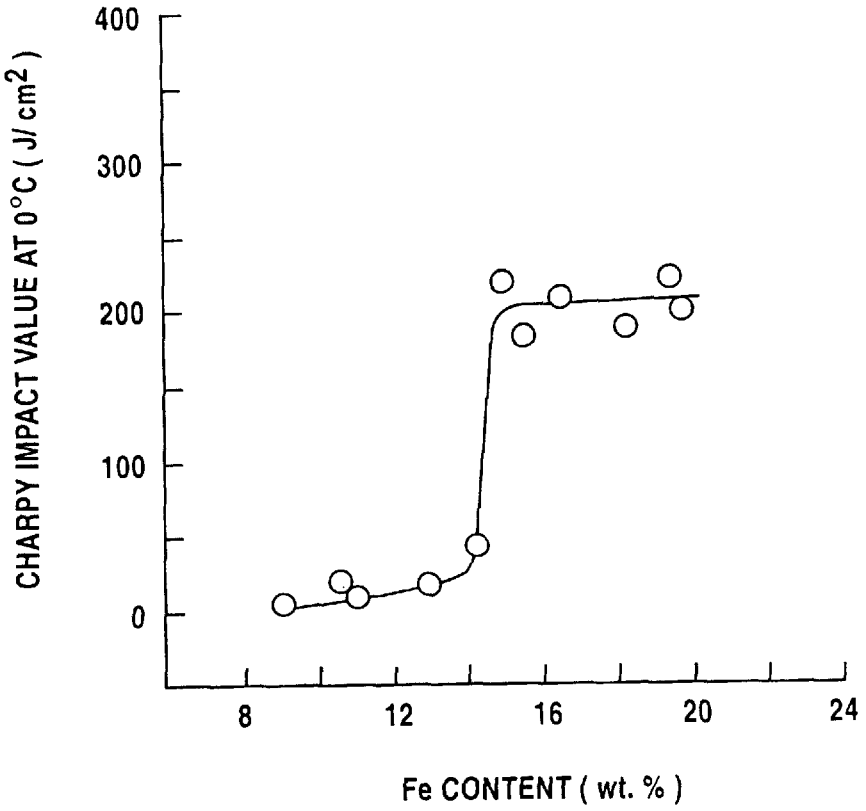
FIG. 4 is a graph showing high temperature embrittlement of the alloys tested in Example as a function of Fe content.

FIG. 4 is a graph showing the high temperature embrittlement of alloys Nos.11 to 25 (except No.14 and Nos.21 to 23) as a function of Fe content. The test conditions will be described in section II-iii in Example hereinafter. As shown in FIG. 4 the alloys containing more than 15% Fe have large Charpy impact values after aging at elevated temperatures. It means that the high temperature embrittlement is effectively prevented by Fe of more than 15%.

As mentioned above, the high Fe content contributes remarkably to improve the workability and to prevent the high temperature embrittlement. However, too much Fe content makes it difficult to maintain the good corrosion resistance of the alloy, because the higher Fe content means the lower content of Ni which is the base element of the alloy. Therefore, the upper limit of Fe content has been determined to be 20%. Another advantage of the alloy is the low production cost due to the higher Fe content than the alloy 625, in other words, lower Ni content by about 10% than the alloy 625.

P (phosphorus)

P is an inevitable impurity originating in raw materials and detrimental to the workability of the alloy. The hot workability of the alloy be remarkably improved by suppressing P content to be not more than 0.01% in addition to controlling Nb content in the above-mentioned range. It is recommendable to decrease P content as low as possible under 0.01% by using low phosphorus materials and/or by dephosphorizing treatment of the molten alloy.

Ca (calcium) and Mg (magnesium)

Although these elements are not necessary, they can be added when particularly good hot workability of the alloy is required. However, more than 0.01% of Ca or Mg forms intermetallic compounds of low melting point which deteriorate the hot workability.

When Ca and/or Mg is added in order to improve the hot workability, it is preferable that the content of each or in total is not less than 0.003%.

REM (rare earth metals)

Although REM such as Y, La and Ce are not indispensable elements, they can be added optionally to improve the hot workability as in the case of Ca and Mg. REM is also effective to improve the adhesion of protective film (a film having the effect to prevent oxidation) which appears on the surface of the alloy during high temperature use, and thereby improve resistance to high temperature oxidation of the alloy. The effect of REM becomes remarkable when the total amount of REM is not less than 0.02%. The effect increases much more if Ca and/or Mg may coexist with REM. However, in case the REM content is more than 0.1%, the hot workability decreases due to formation of intermetallic compounds with Ni, Cr, Mo etc.

B (boron)

B segregates on grain boundaries of the alloy and strengthens the grain boundaries. Thereby B improves resistance to the high temperature creep deformation caused by grain boundary slip. Therefore, B may be added to obtain such effect. The preferable range of B content is 0.002–0.01% if B is added, because less than 0.002% B does not exhibit remarkable effect and more than 0.01% B forms low melting point compounds such as NiB which reduce the hot workability of the alloy.

Up to 0.40% of Ti is allowed in the alloy 625 standardized in JIS G 4903 and 4904. Ti has been used to fix N as TiN precipitates, since N forms $Cr_2N$ which precipitates on grain boundaries and reduces the corrosion resistance of the alloy. However, it has been found that N being not fixed by Ti does not have any detrimental effect to the corrosion resistance of the alloy of this invention, because the solid solubility of $Cr_2N$ becomes higher in the alloy containing not less than 15% Fe. As mentioned above Ti causes surface defects in hot-extruded tubes. Therefore, the intentional addition of Ti should be avoided, and it is preferable to suppress the content of Ti as an incidental impurity to be not more than 0.1%.

The nickel-based alloy of the present invention can be produced in the conventional industrial process and installations. For example, after melting of materials such as Ni, Cr, Fe etc. in an arc furnace or a high frequency induction furnace, deoxidization and adjusting of the chemical composition, ingots or slabs are produced in the ingot forming process or the continuous casting process. It is recommendable to use a vacuum melting and/or a vacuum treatment in the composition adjusting process.

In case of producing a seamless tube from the ingot, the ingot is formed into a billet for the hot extrusion and the tube is made of the billet in Ugine-Séjournet process, for instance. Plates can be made of slabs by hot rolling.

The tube (tube blank) produced by the hot extrusion is subjected to softening heat treatment, cold rolling or cold drawing to form into the determined product size. Thereafter, the tube is subjected to the solution treatment comprising heating at a temperature range from 1000° to 1200° C. and rapid cooling. The tubes thus produced are assembled by bending and welding into a panel which is installed in an apparatus such as a boiler.

Although the alloy of this invention can be used as plates, rods or other products e.g., welding wires, the alloy is most suitable for tubes because of its superior workability. The tube may be not only a sole layer tube (consisting of the alloy only) but also a composite tube having two layers in which a layer exposed to corrosive environments is made of the alloy and the other layer is made of a cheaper material such as a carbon steel, a low alloy steel and a stainless steel. A three layer composite tube can also be made using the alloy for the inner and outer layers, both of which are exposed to corrosive environments. The intermediate layer can be the above-mentioned cheaper materials.

The composite tubes can be produced by coextrusion of a composite billet consisting of two or three layers.

EXAMPLE

I. Preparation of Test Specimens

Alloys having the chemical compositions as shown in Table 1 were melted in a vacuum melting furnace and cast into ingots each having a weight of 50 kg. After being peeled the ingots were heated at a temperature of 1200° C. for 5 hours and forged in a temperature range between 1200° C. and 1050° C. into plates of 20 mm thickness and 100 mm width. Specimens, except specimens for Gleeble test, were prepared by subjecting the forged plates to the softening annealing at 1100° C. for 2 hours and the cold rolling to obtain 14 mm thick plates. The solution treatment was carried out in a condition of heating at 1100° C. for 1 hour and water cooling. The specimens for Gleeble test were cut out of the ingots.

Some of the plates after solution treatment were further cold rolled into 11.2 mm thick plates (rolling reduction: 20%) in order to simulate an application to the boiler panel.

II. Conditions Thereof i. Hot Workability

Rods of 10 mm diameter were cut out of the ingots and heated at 1250° C. Gleeble test was carried out at 1225° C. using the rods as the specimens.

ii. Cold Workability

Cold workability was evaluated by the reduction of area in the room temperature tensile tests using No. 4 specimens (6 mm diameter) standardized in JIS Z 2241.

iii. Embrittlement due Aging (High Temperature Embrittlement)

The embrittlement due to aging was evaluated by impact values measured in Charpy impact tests at 0° C. using specimens heated at 650° C. for 300 hours. The specimens were No.4 specimens in JIS Z 2202.

iv. Resistance to Wet Corrosion

Resistance to wet corrosion was evaluated by three examinations of the following ① to ③. Examined materials were alloys of this invention Nos.9,10 and 15 to 23, comparative alloy No.A (alloy 625), and comparative alloy No.B (the alloy disclosed in WO 095/31579). Specimens of 10 mm width, 40 mm length and 3 mm thickness were cut out of the thickness center of the plates. The length of specimens was 75 mm only for the stress corrosion cracking tests.

① Resistance to Grain Boundary Corrosion in Nitric Acid Solution

Huey test (65% nitric acid corrosion test) standardized in JIS Z 0573 was carried out. Specimens which had been cold worked by 20% reduction (assuming the bending portion of tubes) were sensitized by heating at 750° C. for one hour and air cooling. The conditions are considered to be the severest sensitizing condition.

TABLE 1

| Alloy | Chemical Composition (wt. %) | | | | | | | | | | |
|---|---|---|---|---|---|---|---|---|---|---|---|
| No. | C | Si | Mn | Ni | Cr | Mo | Ti | Nb | Al | Fe | others |
| A | 0.02 | 0.40 | 0.38 | 60.3 | 21.6 | 8.9 | 0.20 | 3.7 | 0.19 | 4.3 | |
| B | 0.005 | 0.42 | 0.30 | 60.1 | 21.6 | 8.6 | 0.21 | — | 0.10 | 8.6 | |
| 1 | 0.02 | 0.21 | 0.19 | 63.1 | 21.3 | 8.7 | — | — | 0.24 | 6.2 | |
| 2 | 0.02 | 0.21 | 0.19 | 62.4 | 21.2 | 8.9 | — | 0.18 | 0.24 | 6.6 | |
| 3 | 0.02 | 0.20 | 0.19 | 61.8 | 21.4 | 9.1 | — | 0.42 | 0.26 | 6.6 | |
| 4 | 0.02 | 0.21 | 0.22 | 62.7 | 20.9 | 8.8 | — | 0.60 | 0.24 | 6.3 | |
| 5 | 0.02 | 0.20 | 0.20 | 62.6 | 21.2 | 8.8 | — | 0.80 | 0.25 | 5.9 | |
| 6 | 0.007 | 0.20 | 0.20 | 53.1 | 21.3 | 8.7 | — | — | 0.22 | 16.2 | |
| 7 | 0.007 | 0.19 | 0.21 | 52.7 | 21.2 | 9.2 | — | 0.23 | 0.20 | 16.0 | |
| 8 | 0.007 | 0.20 | 0.20 | 52.8 | 21.1 | 9.0 | — | 0.37 | 0.20 | 16.1 | |
| 9 | 0.007 | 0.21 | 0.21 | 53.2 | 20.8 | 9.1 | — | 0.66 | 0.19 | 15.6 | |
| 10 | 0.007 | 0.21 | 0.22 | 51.9 | 21.6 | 8.9 | — | 0.83 | 0.21 | 16.0 | |
| 11 | 0.02 | 0.26 | 0.31 | 59.1 | 21.3 | 8.7 | — | 0.55 | 0.20 | 9.5 | |
| 12 | 0.02 | 0.22 | 0.29 | 58.3 | 20.9 | 8.8 | — | 0.63 | 0.21 | 10.5 | |
| 13 | 0.01 | 0.20 | 0.29 | 57.7 | 21.0 | 8.7 | — | 0.91 | 0.25 | 10.9 | |
| 14 | 0.01 | 0.22 | 0.30 | 52.6 | 20.9 | 9.0 | — | 1.14 | 0.22 | 15.6 | |
| 15 | 0.02 | 0.21 | 0.29 | 55.2 | 20.1 | 8.2 | — | 0.56 | 0.26 | 15.1 | |
| 16 | 0.01 | 0.21 | 0.31 | 53.7 | 20.8 | 8.6 | — | 0.63 | 0.24 | 15.4 | |
| 17 | 0.01 | 0.19 | 0.31 | 50.1 | 22.8 | 8.9 | — | 0.91 | 0.24 | 16.5 | |
| 18 | 0.02 | 0.20 | 0.30 | 48.2 | 21.2 | 9.7 | — | 0.64 | 0.25 | 18.4 | |
| 19 | 0.02 | 0.20 | 0.29 | 48.1 | 21.6 | 9.4 | — | 0.54 | 0.22 | 19.6 | |
| 20 | 0.02 | 0.19 | 0.31 | 48.2 | 21.5 | 8.9 | — | 0.87 | 0.26 | 19.7 | |
| 21 | 0.01 | 0.19 | 0.21 | 52.5 | 21.2 | 8.9 | — | 0.61 | 0.21 | 16.1 | B: 0.0025 |
| 22 | 0.02 | 0.21 | 0.19 | 52.7 | 21.3 | 8.8 | — | 0.59 | 0.20 | 15.9 | Ca: 0.003<br>Mg: 0.004 |
| 23 | 0.01 | 0.20 | 0.19 | 52.3 | 21.3 | 8.9 | — | 0.62 | 0.20 | 16.2 | Y: 0.04 |
| 24 | 0.02 | 0.19 | 0.31 | 56.0 | 21.2 | 8.2 | — | 0.71 | 0.19 | 13.1 | |
| 25 | 0.01 | 0.19 | 0.29 | 54.7 | 20.8 | 8.6 | — | 0.86 | 0.19 | 14.2 | |

Note

Alloy A: Alloy 625

Alloy B, Nos.1–8, 11–14, 24–25: Alloys of the Comparative Example

Alloy Nos. 9–10, 15–23: Alloys of the Present Invention

② Resistance to Stress Corrosion Cracking in Dense Chloride Solution

Resistance to stress corrosion cracking was evaluated by the test using the U-bend specimens and boiling 42% $MgCl_2$ solution standardized in JIS G 0576. After 100 hours dipping of said sensitized U-bend specimens in the solution, stress corrosion cracks (SCC) were inspected.

③ Corrosion Resistance to Acid Solution and Alkali Solution

Evaluations were carried out by measurement of weight loss after dipping in three kinds of solutions, 50% NaOH solution (boiling), 50% sulfuric acid solution (80° C.) and 5% HCl solution (50° C.).

v. Resistance to Oxidation in the Air

Resistance to oxidation was evaluated by weight gain of the specimens heated at 1000° C. for 1000 hours.

vi. Corrosion Resistance at Elevated Temperatures

The following tests ① and ② were carried out in order to evaluate the high temperature corrosion resistance of the welding heat affected zone. Welding conditions were as follows:

The 14 mm thick solution treated plates were grooved and welded using welding rod AWS ER NiCrMo-3. The welding method was GTAW. The first layer was made by a heat input of 9.4 KJ/cm, and the second to seventh layers were made by 14.4 KJ/cm. Test specimens were cut out of the heat affected zone.

① Corrosion resistance was evaluated in high temperature corrosive environments wherein the boiler parts such as super heater tubes, economizer tubes and water-wall panel tubes, gas-gas heat exchanger tubes of the industrial waste incineration boilers are used.

Specimens of 15 mm width, 15 mm length and 3 mm thickness which have the heat affected zone at the center were used in this test. A synthetic ash was painted on the specimens with 30 mg/cm$^2$. The synthetic ash was prepared simulating the corrosive ash which sticks to tubes of the boilers, and it contains $Na_2SO_4$, $K_2SO_4$, NaCl, KCl, $FeCL_2$, $Fe_2O_3$ and $PbCl_2$, in which Pb content was 20.28% as PbO, Cl content was 18.5% and $SO_3$ content was 19.58% in weight.

② Specimens were heated at 400° C. for 20 hours in a furnace in which a corrosive gas having a chemical composition of 1500 ppm HCl—100 ppm $SO_2$—7.5% $O_2$—7.5% $CO_2$—20% $H_2O$—bal. $N_2$ simulating the waste gas of the incinerator was introduced. Weight loss and the maximum intergranular corrosion depth of the specimens were measured by microscopic inspection.

III. Test Results i. Hot Workability

The Gleeble test results are shown in Table 2. The results are also shown in FIG. 3 as a function of Fe content and Nb content. All alloys of this invention (Nos.15–20) have large reduction area values of not less than 80%, i.e., the alloys can be hot extruded without any difficulty. On the other hand, reduction of area values of the alloys (Nos.11–14, 24 and 25) which do not contain sufficient amounts of Fe are less than 10%. It means that the hot workability of those alloys is very poor.

It has been confirmed that Fe of not less than 15% is necessary to improve the hot workability of the alloy containing Nb. The conventional alloy 625 (comparative alloy A) shows 0% reduction of area. The hot workability of the alloy is extremely poor.

It is evident from FIG. 3 that not less than 80% reduction of area at 1225° C. can be obtained under the condition of $Fe(\%) \geqq 4 \times Nb(\%) + 12.5$. The temperature of 1225° C. is conventionally used for the hot extrusion works of stainless steel tubes.

TABLE 2

| | Alloy No. | Reduction of Area in Gleeble Test (%) |
|---|---|---|
| Alloy of the Comparative Example | 11 | 5 |
| | 12 | 5 |
| | 13 | 0 |
| | 14 | 0 |
| Alloy of the Present Invention | 15 | 90 |
| | 16 | 85 |
| | 17 | 80 |
| | 18 | 85 |
| | 19 | 85 |
| | 20 | 80 |
| Alloy of the Comparative Example | 24 | 5 |
| | 25 | 5 |
| | A | 0 |
| | B | 75 |

ii. Cold Workability

The cold workability evaluated by the reduction of area measured in the room temperature tensile tests are shown in Table 3. As is apparent from the table, the reduction of area of the alloys of this invention reaches the 80% mark. It means that the cold workability of the alloy of this invention is also superior to that of the conventional alloy 625 (the comparative alloy A).

TABLE 3

| | Alloy No. | Reduction of Area in Room Temperature Tensile Test (%) |
|---|---|---|
| Alloy of the Comparative Example | A | 60 |
| | B | 80 |
| | 2 | 75 |
| Alloy of the Present Invention | 9 | 85 |
| | 16 | 82 |
| | 21 | 80 |
| | 22 | 83 |
| | 23 | 85 |

iii. Embrittlement due to Aging

Charpy impact values of the alloy after aging are shown in Table 4. Among the results in Table 4, impact values of the alloys containing 0.5–1.0% Nb are shown in FIG. 4 as a function of Fe content.

It has been confirmed from the results in Table 4 and FIG. 4 that the resistance to the high temperature embrittlement of the high Mo alloy containing 0.5–1.0% Nb depends greatly on its Fe content, and that the Fe content of not less than 15% improves the resistance to the high temperature embrittlement remarkably. As is shown in Table 4 Charpy impact value of the conventional alloy 625 (the comparable alloy A) after being aged at 650° C. for 3000 hours is 5 J/cm$^2$ meaning an extraordinary embrittlement.

TABLE 4

| | Alloy No. | Charpy Impact Value at 0° C. (J/cm$^2$) |
|---|---|---|
| Alloy of the Comparative Example | 11 | 8 |
| | 12 | 20 |
| | 13 | 15 |
| Alloy of the Present Invention | 15 | 220 |
| | 16 | 182 |
| | 17 | 210 |
| | 18 | 193 |

TABLE 4-continued

| | Alloy No. | Charpy Impact Value at 0° C. (J/cm$^2$) |
|---|---|---|
| | 19 | 222 |
| | 20 | 200 |
| Alloy of the | 24 | 21 |
| Comparative | 25 | 40 |
| Example | A | 5 |
| | B | 160 |

iv. Resistance to Corrosion

① Test results of the intergranular corrosion (due to sensitizing) and the stress corrosion cracking in the nitric acid solution are shown in Table 5. The results of the intergranular corrosion tests are also shown in FIG. 1 as a function of Nb content.

It is apparent from the results in Table 5 and FIG. 1 that the sensitizing property of the cold worked alloys depends greatly on the Nb content, and that more than 0.5% Nb is necessary to prevent sensitization.

② The superior resistance to the stress corrosion cracking in the dense chloride solution is not substantially depressed if Fe content becomes 20%, i.e., Ni content is reduced.

TABLE 5

| | Alloy No. | Resistance to Intergrarular Corrosion of Cold Rolled Specimens (Weight loss; g/m$^2$/h) | Resistance to Stress Corrosion Cracking |
|---|---|---|---|
| Alloy of the | 1 | 20 | No Cracks |
| Comparative | 2 | 12 | No Cracks |
| Example | 3 | 14 | No Cracks |
| | 4 | 1.5 | No Cracks |
| | 5 | 1.2 | No Cracks |
| | 6 | 12 | No Cracks |
| | 7 | 12 | No Cracks |
| | 8 | 7.8 | No Cracks |
| Alloy of the | 9 | 1.4 | No Cracks |
| Present | 10 | 1.1 | No Cracks |
| Invention | | | |
| Alloy of the | A | 1.0 | No Cracks |
| Comparative | B | 18 | No Cracks |
| Example | | | |

③ Results of the corrosion tests in the acid solution and the alkali solution are shown in Table 6, from which it is apparent that the corrosion resistance to the acid and alkali is substantially the same as that of the conventional alloy 625.

v. Resistance to Oxidation in the Air

Test results are also shown in Table 6. The resistance to oxidation is almost the same level as that of the alloy 625.

TABLE 6

| | | Corrosion Rate (g/m$^2$/h) | | | Resistance to Oxidation |
|---|---|---|---|---|---|
| | Alloy No. | 50% NaOH (boiled) | 50% $H_2SO_4$ (80° C.) | 5% HCl (50° C.) | weight gain (mg/cm$^2$) |
| Alloy of | A | less than 0.03 | 0.45 | 0.05 | less than 3 |
| the Com- | B | less than 0.03 | 0.44 | 0.07 | less than 3 |
| parative | 2 | less than 0.03 | 0.42 | 0.06 | less than 3 |
| Example | | | | | |
| Alloy | 9 | less than 0.03 | 0.40 | 0.04 | less than 3 |
| of the | 16 | less than 0.03 | 0.38 | 0.04 | less than 3 |
| Present | 21 | less than 0.03 | 0.42 | 0.05 | less than 3 |
| Invention | 22 | less than 0.03 | 0.41 | 0.05 | less than 3 |
| | 23 | less than 0.03 | 0.40 | 0.04 | less than 3 |

vi. High Temperature Corrosion Resistance of the Welding Heat Affected Zone

The test results are shown in Table 7. Some of the results are shown in FIG. 2 as a function of Nb content. As is apparent from Table 7, remarkable intergranular corrosion due to sensitization occurs in the alloy (alloy B, Nos.1–3, and 6–8) containing no or small amounts of Nb in such a severe corrosive environment as the testing condition. It has been confirmed that he alloy of this invention which contains more than 0.5% of Nb has an excellent high temperature corrosion resistance as the alloy 625.

TABLE 7

| | | Welding Heat Affected Zone (HAZ) | |
|---|---|---|---|
| | Alloy No. | Weight loss (m/cm$^2$) | Maximum Integrarular Corrosion Depth ($\mu$m) |
| Alloy of the | A | 12.5 | less than 2.5 |
| Comparative | B | 14.2 | 280 |
| Example | 1 | 14.0 | 240 |
| | 2 | 13.2 | 210 |
| | 3 | 12.6 | 120 |
| | 4 | 12.5 | less than 2.5 |
| | 5 | 12.3 | less than 2.5 |
| | 6 | 14.0 | 160 |
| | 7 | 13.4 | 180 |
| | 8 | 13.2 | 120 |
| Alloy of the | 9 | 12.6 | less than 2.5 |
| Present | 10 | 12.4 | less than 2.5 |
| Invention | 21 | 12.6 | less than 2.5 |
| | 22 | 12.5 | less than 2.5 |
| | 23 | 12.5 | less than 2.5 |

As shown in Example, the alloy of the present invention has an exceptional hot workability for the Ni-based alloy of high Mo content. Therefore, it can be hot extruded into seamless tubes without any difficulty. Furthermore, cold drawing and cold rolling are relatively easy because the alloy also has a good cold workability.

Tubes(single layer tubes) made of the alloy of this invention also exhibited a good high temperature strength and creep rupture strength. For example, the strength at 550° C. is about 600 MPa which is higher than 470 MPa of JIS SUS 316 HTB. The creep rupture strength 600° C. is almost equal to that of SUS 316 HTB which is high enough for boiler tubes to be used at elevated temperatures.

the alloy of this invention exhibits the excellent corrosion resistance of almost the alloy 625 in various severe corrosive environments. In addition, since the alloy of this invention has such good hot and cold workability as mentioned above, tubes can be made of the alloy without surface defects. Accordingly, it is possible to reduce the production cost of tubes by eliminating the defects removing step and increase product yield. Furthermore, the alloy of this invention is much more economical because of its lower Ni content in comparison with the alloy 625.

Using the alloy of the present invention, not only the single layer seamless tubes but also composite seamless tubes such as double layers or triple layers tubes can be manufactured easily, although it is difficult to manufacture the composite tubes of the conventional alloy 625. Since seamless tubes made of the alloy of this invention have the improved structure stability at elevated temperatures, the resistance to high temperature embrittlement of the tubes is excellent even if they are used at high temperatures for a long period of time. The high temperature embrittlement is one of the problems of the conventional alloy 625 tubes. Accordingly, the alloy of this invention is particularly suitable for pipes, tubes or structural members of apparatus which should be operated for a long period of time in high temperature and severe corrosive environments.

Although this invention has been described with respect to a preferred embodiment thereof, it should be understood by those skilled in the art that various changes and modifications in the detail thereof may be made therein and thereto without departing from the spirit and scope of the invention.

What is claimed is:

1. An alloy excellent in corrosion resistance and workability consisting essentially of, in weight %:

| | | |
|---|---|---|
| up to 0.05% C, | up to 0.5% Si, | up to 0.5% Mn, |
| up to 0.01% P | 20–25% Cr, | 8–12% Mo, |
| more than 0.5% and up to 1.0% Nb, | | more than 15% and up to 20% Fe, |
| up to 0.4% Al, | up to 0.1% in total of rare earth metals, | |
| up to 0.01% Ca, | up to 0.01% Mg, | up to 0.01% B, |

and the balance Ni and incidental impurities, wherein the Fe content and the Nb content are defined so as to satisfy the following formula (a):

$$Fe(\%) \geqq 4 \times Nb(\%) + 12.5 \quad (a).$$

2. A seamless tube made of the alloy according to claim 1.

3. A seamless composite tube wherein at least one layer of the outer layer and the inner layer is made of the alloy according to claim 1.

4. A component of the industrial waste incinerating boiler made of the alloy according to claim 1.

5. A seamless tube for the industrial waste incinerating boiler made of the alloy according to claim 1.

6. A seamless composite tube for the industrial waste incinerating boiler wherein at least one layer of the outer layer and the inner layer is made of the alloy according to claim 1.

* * * * *